US005492383A

United States Patent [19]

Kentner, Sr.

[11] Patent Number: 5,492,383

[45] Date of Patent: *Feb. 20, 1996

[54] SLING ASSEMBLY FOR HOISTING TRACTION MOTOR/WHEEL UNITS AND METHOD

[75] Inventor: Michael J. Kentner, Sr., Long Beach, Calif.

[73] Assignee: BC Industrial Supply, Inc., Orange, Calif.

[ * ] Notice: The portion of the term of this patent shall not extend beyond the expiration date of Pat. No. 5,415,449.

[21] Appl. No.: 295,204

[22] Filed: Aug. 24, 1994

Related U.S. Application Data

[63] Continuation-in-part of Ser. No. 129,987, Sep. 30, 1993, Pat. No. 5,415,449.

[51] Int. Cl.[6] ..... B66C 1/14

[52] U.S. Cl. ..... 294/74

[58] Field of Search ..... 294/74–77, 82.12; 57/201, 210, 224

[56] References Cited

U.S. PATENT DOCUMENTS

| | | | |
|---|---|---|---|
| 2,343,045 | 2/1944 | Butler | 294/74 |
| 2,541,449 | 2/1951 | Vickers | 294/74 |
| 3,463,534 | 8/1969 | Norton | 294/74 |
| 3,582,125 | 6/1971 | Collins | 294/82.12 |
| 4,052,095 | 10/1977 | Johnson | 294/74 |
| 4,171,840 | 10/1979 | Berzenye | 294/74 |
| 4,200,325 | 4/1980 | Johnson | 294/74 |
| 5,415,449 | 5/1995 | Kentner, Sr. | 294/74 |

OTHER PUBLICATIONS

Brokerick & Bascom Rope Co.—copy of page from their brochure showing braided rope traction motor slings, no date.

*Primary Examiner*—Dean Kramer
*Attorney, Agent, or Firm*—Harold L. Jackson

[57] ABSTRACT

A lifting sling assembly for hoisting railroad locomotive traction motor/wheel units includes a master link made of steel for example, and a first pair of loop slings secured at one end to the master link. The other end of each of the loop slings is adapted to extend around opposite ends of the axle between the respective wheel and a bearing journal box mounted on the terminal end of the axle. A second pair of loop slings are also secured to at one end to the master link and arranged to be secured at the other end to the motor housing to prevent rotation thereof during the hoisting operation. Each of the loop slings comprises a core of high performance endless parallel fibers enclosed in a tubular abrasion resistant covering. The first pair of slings further include a cut and abrasion resistant sleeve surrounding the tubular covering over the length thereof which is adapted to engage the axle and wheel.

18 Claims, 3 Drawing Sheets

SLING ASSEMBLY FOR HOISTING TRACTION MOTOR/WHEEL UNITS AND METHOD

This application is a continuation-in-part of application Ser. No. 129,987 filed Sep. 30, 1993, now U.S. Pat. No. 5,415,449.

FIELD OF THE INVENTION

The present invention relates to lifting sling assemblies and more particularly to slings for lifting railroad traction motors and car wheels.

BACKGROUND OF THE INVENTION

Prior art lifting slings for lifting railroad traction motor assemblies as illustrated in FIG. 1 of the drawings, comprise a pair of main cables designated 10 and 12. Each of the main cables is formed of several parts (i.e., eight) of strand wire rope braided together and connected through thimble eyes 14 to a master link 16 at one end and to a steel hoist hook 18 at the other end.

The hooks are adapted to engage the outside rim of the pair of drive wheels 19 which are mounted on the shaft of the traction motor 20. A pair of auxiliary wire rope cables 22 extend between the master link and hooks 24 which engage eyelets in the motor casing to prevent the casing from rotating relative to the wheels during the lifting operation.

The chamfer at the outer rim of the drive wheels is not uniform from wheel to wheel with the result that a hoist book's purchase on the rim may be insufficient on some wheels allowing the wheel assembly to fall.

The energy stored in the wire cables as a result of elastic elongation during a lifting operation provides a hazardous situation should one of the hoise hooks slip off the wheel rim. The stored energy when released may result very rapid movement of one or more of the cables endangering any individual positioned near the traction motor assembly during the lifting operation.

There is a need for a sling assembly and method which overcomes the above problems.

SUMMARY OF THE INVENTION

A sling assembly for hoisting railroad locomotive traction motor/wheel units includes a master link and a first pair of loop slings secured at one end to the master link. The motor/wheel units have a pair of wheels and a motor mounted between the wheels on a common axle with the axle extending beyond the wheels and terminating at each end in a bearing journal box. The other ends of the first pair of slings are adapted to extend around opposite ends of the axle between the respective wheel and the bearing journal box. A second pair of loop slings are also secured at one end to the master link and at the other end to a respective hook. Each hook is designed to engage an eye on the motor housing to prevent rotation of the housing while the unit is being hoisted.

Each of the loop slings has a core of high performance endless parallel fibers enclosed in a tubular abrasion-resistant covering. Each loop sling of the first pair also includes a cut and abrasion resistant sleeve surrounding the tubular covering over the length thereof which is adapted to engage the axle and wheel. The cut resistant sleeve is in the form of high performance fibers woven at right angles to each other and sewn between inner and outer sheets of abrasion resistant material. The high performance fibers have a strength-to-weight ratio within the range of about 20 to 30 grams per denurs ("GPD").

The construction and operation of the present invention can best be understood by reference to the following description taken in conjunction with the accompanying drawings.

DESCRIPTION OF THE PREFERRED EMBODIMENT

Figure 2:
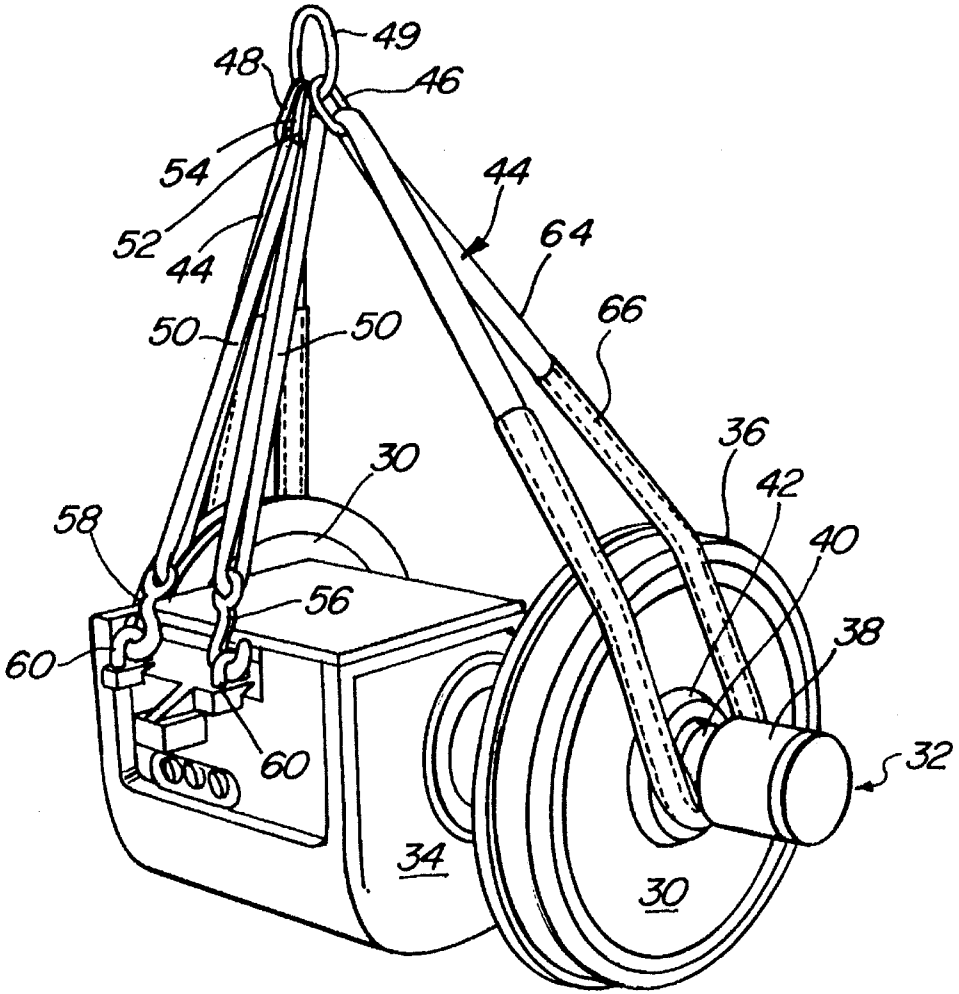
FIG. 2 is a perspective view of sling assembly for such units in accordance with the invention.
Figure 1:
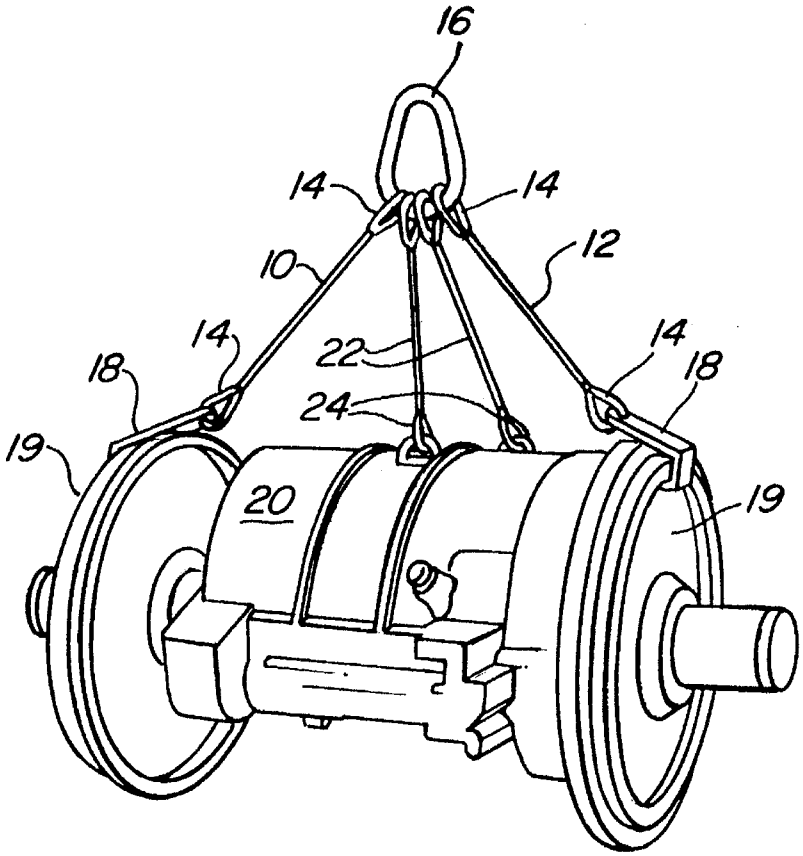
FIG. 1 PRIOR ART
FIG. 1 is a perspective view of a prior art sling assembly for traction motor/wheel units.
Figure 3:
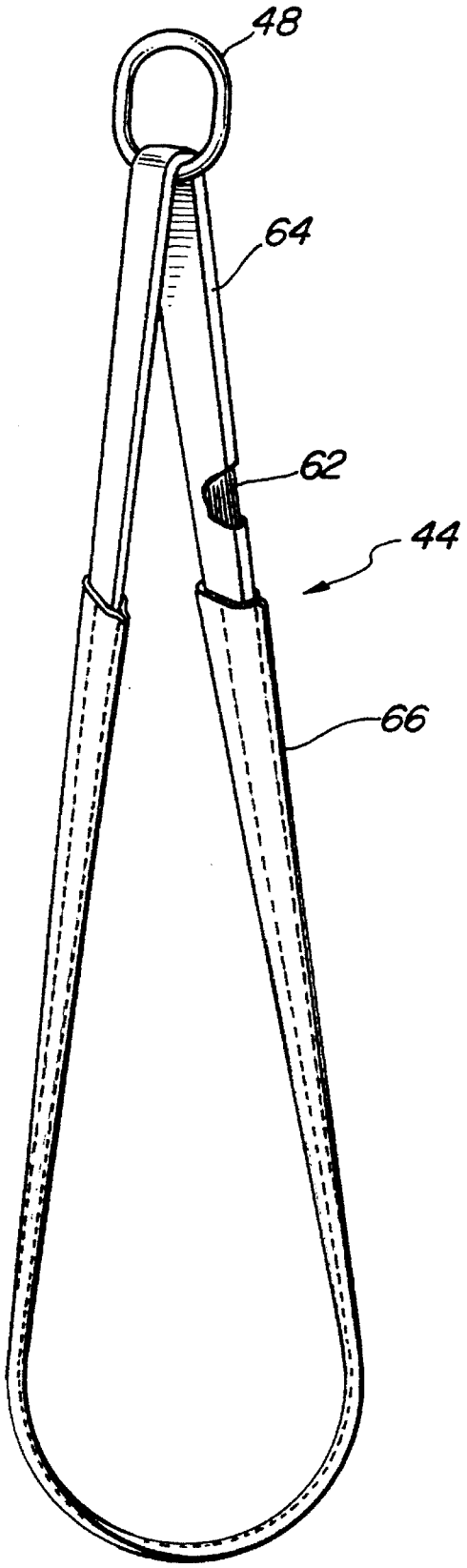
FIG. 3 is an enlarged perspective of one of the axle engaging slings of FIG. 2 partially broken away to illustrate the core.
Figure 4:
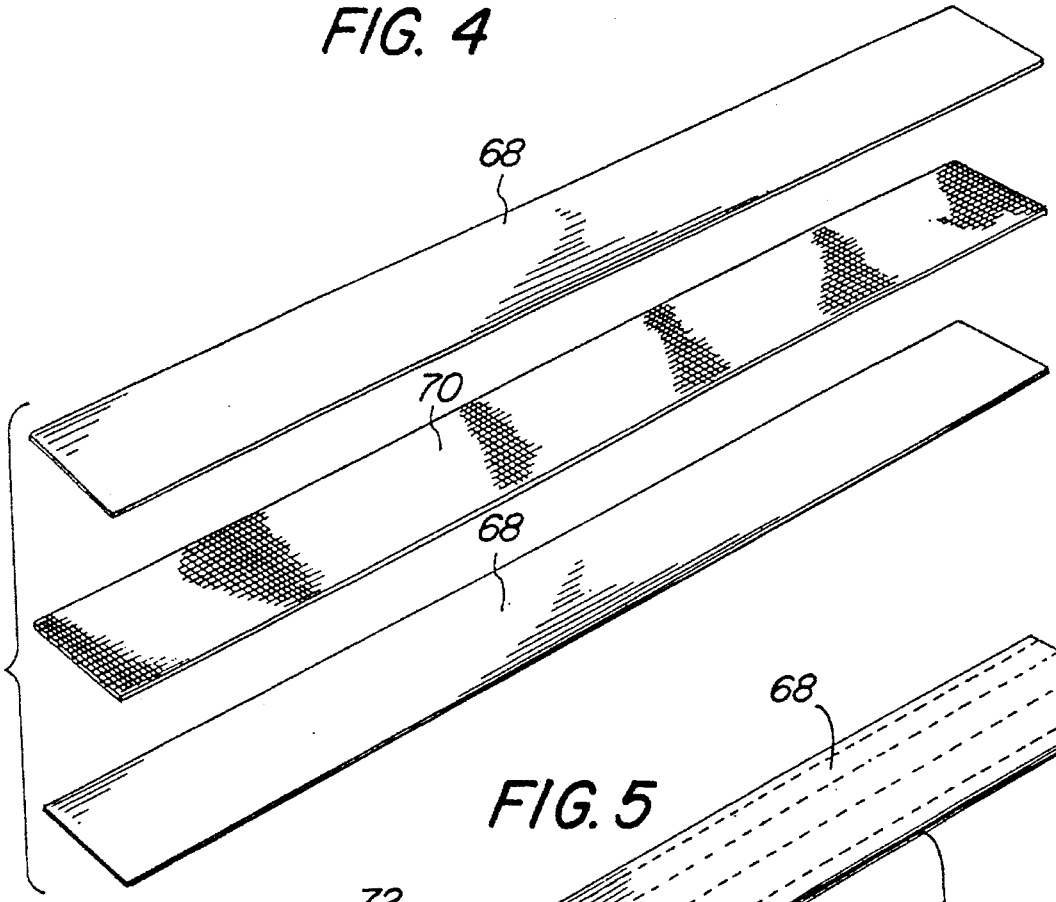
FIG. 4 is an exploded perspective view of the components of the cut proof sleeve in planar form.
Figure 5:
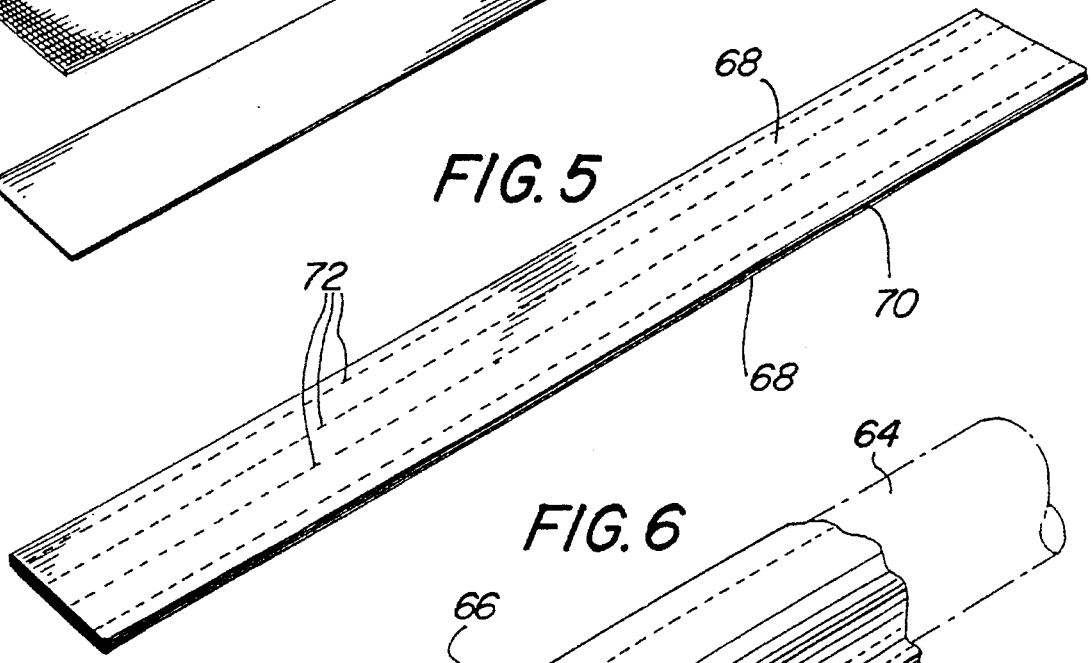
FIG. 5 is a perspective view of the sleeve of FIG. 3 in its assembled planar form.
Figure 6:
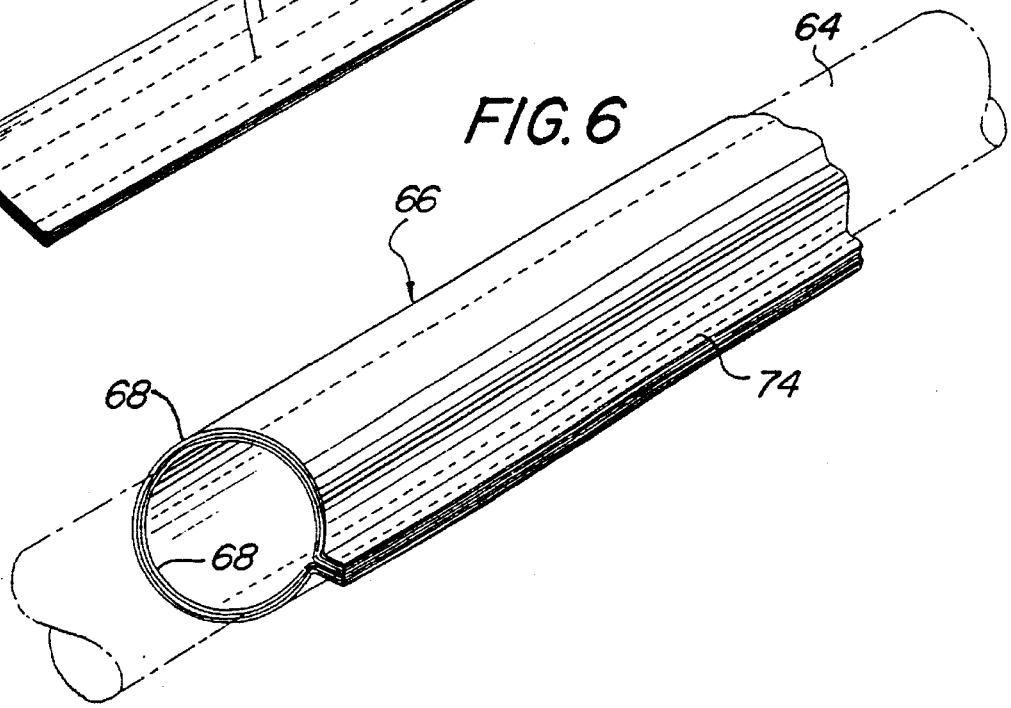
FIG. 6 is a perspective view of the sleeve of FIG. 4 wrapped around a portion of the sling.

Referring now to the drawings and particularly to FIG. 2, the traction motor/wheel unit to be hoisted comprises a drive wheel 30 mounted on and keyed to an axle 32. A traction motor has a rotor secured for rotation with the axle and a surrounding stator (not shown) mounted within a housing 34. Each wheel has an outside rim 36 which typically forms a sharp edge short time after the wheel is run on the track. The axle 32 terminates at each end in a bearing journal box 38 which supplies lubricant to the locomotive/wheel bearings located between the motor 34 and each wheel, e.g. at 38. Each unit includes a recessed axle section 40 between the inner end of the journal box and the hub 42 of the wheel.

A first pair of loop slings 44 of high performance fiber construction, to be described in more detail, extend through sub-links 46 and 48 at one end and at the other end pass around opposite ends of the axle 32 between the journal box 38 and the wheel hub 42 in the recess 40. A master link 49 passes through the sub-links 46 and 48. The master link enables a crane (via a hook not shown) to hoist the traction motor/wheel unit.

A second pair of loop slings 50 (also of high performance fiber construction) extend through sub-links 52 and 54 at one end and through the eyes of hooks 56 and 58 at the other end as illustrated. The master link 49 also passes through the sub-links 52 and 54. The hooks 56 and 58 extend through eyes 60 on the motor housing 34. The slings 50 prevent the motor housing from rotating relative to the wheels 30 during the hoisting operation.

Referring now to FIGS. 3–6 each loop sling 44 comprises a core bundle of high performance fibers 62 twisted into parallel yarns which are wound into an endless loop in a well known manner. The high performance fibers have a strength to weight ratio in excess of 20 GPD and preferably within the range of about 20 to 30 GPD. Most preferably the fibers have a strength to weight ratio within the range of 23 to 27 GPD. Kevlar aramid and Spectra fibers provide a strength to weight ratio of 23 and 27 GPD, respectively, and are ideally suited for the core. We have found that a blend of Kevlar and Spectra fibers (50/50) twisted into yarns result in a core (and sling) which is easy to manipulate and provides a reliable lifting element with a strength to weight ratio of about 26 GPD. The yarns are preferably about ¼" in diameter. See the pending application Ser. No. 08/129,987 filed Sep. 30, 1993 now U.S. Pat. No. 5,415,449 assigned to the assignee of this application.

The core of endless fiber yarns is encased in a protective tubular covering 64 with the ends thereof sewn or otherwise fastened together to form a loop sling. The protective covering may be made of an abrasion or wear resistant material such as Cordura. Kevlar and Cordura are trademarks of E. I. Dupont Nemours, and Spectra is a trademark of Allied Signal. Such high performance fibers have a maximum stretch of about 0.0001% at rated load and are about 90% lighter than steel with a comparable lifting capacity. The diameter of the tubular covering is chosen to restrain any movement of the fiber yarns therein. The overall diameter of the sling may run about three to four inches to provide a lifting capacity which will allow the entire weight of the traction motor/wheel unit i.e., about 12,500 pounds to be suspended by either sling.

A cut proof or cut resistant sleeve 66 surrounds the tubular protective covering 64 along the closed curve section which extends around the axle and the wheel 30 to prevent the sharp edge 36 of the wheel rim from penetrating into the protective covering 64 and the high performance fibers 62.

The cut proof sleeve 66 is made up of inner and outer abrasion or wear resistant panels 68 and an inner panel 70 consisting of multiple layers of a high performance fibers and particularly Spectra fibers woven at right angles. The high performance fiber panel 70 is sewn between the panels 68 along longitudinally extending lines 72 as shown. The composite panel layers are then wrapped around the tubular protective covering 64 to form the cut proof sleeve 66. The edges of the composite panel layers are then stitched together at 74.

The cross woven high performance fibers 70 will accommodate a needle to provide the stitching 72 but will resist penetration by a larger object. The longitudinal stitches 72 hold the multiple high performance fibers in place inside the cut proof sleeves. The outer abrasion resistent covering panel 68, which may be made of Cordura, protects the high performance fiber layers from abrasion damage and thus extends the life of the sling.

The loop slings 50 are constructed in the same manner as the slings 44 without the cut resistant sleeve 66. The master link 49 is preferably made of 1¼" diameter steel and the sub-links are made of ¾" diameter steel.

The loop slings 44 are non-abrading and soft as compared with steel and will not damage the journal box or axle. In contrast wire rope slings cannot be positioned over the axle as illustrated in FIG. 2 for hoisting the motor wheel units because the wire will generally damage the journal box. In addition to providing a safe system and method for hoisting traction motor/wheel units, the loop sling assembly of the present invention weighs only about fifty pounds as compared with a weight of over 300 pounds for steel slings having the same configuration. In should be noted that the loop sling assembly of the present invention may also be used to hoist railroad car wheel units per se (without the traction motor) by the use of slings 44 above and without the motor anti-rotation slings 50. It should be noted that a sling assembly designed for hoisting car wheels need only have a fraction of the load lifting capacity of an assembly designed for traction motor/wheel units.

There has thus been described a unique lightweight loop sling assembly for lifting railroad traction motor wheel units while eliminating many of the hazards common to the use of the prior art wire rope sling arrangements. Various modifications of the described preferred embodiment will be apparent to those skilled in the art without involving any departure from the spirit and scope of our invention as defined in the appended claims.

What is claimed is:

1. In a sling assembly for hoisting railroad locomotive traction motor/wheel units, each unit having a pair of wheels and a traction motor housing mounted between the wheels on a common axle, the axle-extending beyond each of the wheels and terminating at each end in a bearing journal box, the combination comprising:

a master link;

a first pair of loop slings secured at one end to the master link, the other end of each loop sling being adapted to extend around a respective end of the axle between the journal box and the wheel;

a second pair of loop slings secured at one end to the master link;

a hook individually secured to the other end of each of the second pair of loop slings;

each hook being adapted to engage an eye on the motor housing to prevent rotation of the housing while the unit is being hoisted;

each of the loop slings comprising a core bundle of high performance endless parallel fibers enclosed in a tubular abrasion resistant covering, each of the first pair of loop slings further including a cut and abrasion resistant sleeve surrounding the loop sling at least over the length thereof which is adapted to engage the axle and the wheel, the cut resistant sleeve comprising a sheet of high performance fibers woven at right angles and sewn between inner and outer sheets of abrasion resistant material, the high performance fibers of each of the first and second loop slings and the cut resistant sleeve having a strength-to-weight ratio within the range of about 20 to 30 GPD.

2. The sling assembly of claim 1 wherein each of the first pair of loop slings are individually secured to the master link by a sub-link.

3. The sling assembly of claim 2 wherein each of the second pair of loop slings are individually secured to the master link by a sub-link.

4. The sling assembly of claim 3 wherein the endless fibers and the tubular abrasion resistant covering of each of the first and second loop slings extend through a respective sub-link.

5. The sling assembly of claim 2 wherein each of the hooks include a closed eye and wherein the endless fibers and the tubular abrasion resistant sleeve of each of the second loop slings extend through the eye of a respective hook.

6. The sling assembly of claim 5 wherein the high performance fibers have a strength-to-weight ratio between 23 and 27 GPD.

7. The sling assembly of claim 6 wherein the high performance fibers of the core bundle are chosen from the group consisting of Spectra and Kevlar.

8. The sling assembly of claim 7 wherein the high performance fibers in the core bundle are a blend of Spectra and Kevlar fibers woven into a yarn.

9. The sling assembly of claim 8 wherein the high performance fibers of each of the cut proof sleeves are made of Spectra.

10. A method of hoisting a railroad locomotive traction motor/wheel unit having a pair of wheels and a traction motor housing mounted between the wheels on a common axle, the axle extending beyond each of the wheels and terminating at each end in a bearing journal box spaced from the respective wheel comprising:

a) forming first and second high performance fiber loop slings with each sling having a core bundle of high performance endless parallel fibers enclosed in a tubular abrasion resistant covering and secured at one end to a master link;

b) forming third and fourth high performance fiber loop slings secured at one end to the master link and at the other end to a hook with each sling having a core bundle of high performance endless parallel fibers enclosed in a tubular abrasion resistant covering;

c) placing the other end of each of the first and second loop slings around the axle between the respective wheel and the journal box;

d) securing each of the hooks attached to the ends of the third and fourth loop slings to the motor housing to prevent the housing from rotating relative to the axle; and e) lifting the master link to thereby lift the unit.

11. The method of claim 10 wherein the high performance fibers of each of the loop slings has a strength-to-weight ratio within the range of about 20 to 30 GPD.

12. In a sling assembly for hoisting railroad car wheel units, each unit having a pair of wheels mounted on a common axle, the axle extending beyond each of the wheels and terminating at each end in a bearing journal box, the combination comprising:

a master link;

a pair of loop slings secured at one end to the master link, the other end of each loop sling being adapted to extend around a respective end of the axle between the journal box and the wheel;

each of the loop slings comprising a core bundle of high performance endless parallel fibers enclosed in a tubular abrasion resistant covering, and further including a cut and abrasion resistant sleeve surrounding the loop sling at least over the length thereof which is adapted to engage the axle and the wheel, the cut resistant sleeve comprising a sheet of high performance fibers woven at right angles and sewn between inner and outer sheets of abrasion resistant material, the high performance fibers of each of the loop slings and the cut resistant sleeve having a strength-to-weight ratio within the range of about 20 to 30 GPD.

13. The sling assembly of claim 12 wherein each of the loop slings are individually secured to the master link by a sub-link.

14. The sling assembly of claim 13 wherein the endless fibers and the tubular abrasion resistant covering of each of the loop slings extend through a respective sub-link.

15. The sling assembly of claim 14 wherein the high performance fibers have a strength-to-weight ratio between 23 and 27 GPD.

16. The sling assembly of claim 15 wherein the high performance fibers of the core bundle are chosen from the group consisting of Spectra and Kevlar.

17. The sling assembly of claim 16 wherein the high performance fibers in the core bundle are a blend of Spectra and Kevlar fibers woven into a yarn.

18. The sling assembly of claim 17 wherein the high performance fibers of each of the cut proof sleeves are made of Spectra.

* * * * *

UNITED STATES PATENT AND TRADEMARK OFFICE

CERTIFICATE OF CORRECTION

PATENT NO. : 5,492,383

DATED : 2/20/96

INVENTOR(S) : Michael J. Kentner, Sr.

It is certified that error appears in the above-identified patent and that said Letters Patent is hereby corrected as shown below:

Column 1, line 32, "book's" should read --hook's--.

Column 4, line 11, "axle-extending" should read --axle extending--.

Signed and Sealed this

Fourth Day of June, 1996

Bruce Lehman

*Attest:*

BRUCE LEHMAN

*Attesting Officer*

*Commissioner of Patents and Trademarks*